US006766531B2

(12) United States Patent
Sullivano et al.

(10) Patent No.: US 6,766,531 B2
(45) Date of Patent: Jul. 27, 2004

(54) BALL GLOVE WITH REINFORCED FINGER STALLS AND A WRIST PANEL WITH SPACED-APART PADDING

(75) Inventors: Brian A. Sullivano, St. Charles, IL (US); Shigeaki Aso, Arlington Heights, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/649,184

(22) Filed: Aug. 27, 2003

(65) Prior Publication Data

US 2004/0034899 A1 Feb. 26, 2004

Related U.S. Application Data

(63) Continuation-in-part of application No. 10/156,584, filed on May 28, 2002, now Pat. No. 6,634,029.

(51) Int. Cl.[7] ..... A41D 13/08
(52) U.S. Cl. ..... 2/19
(58) Field of Search ..... 2/16, 19, 20, 159, 2/160, 161.1, 161.6, 162, 163, 164; 128/878, 879, 880; 473/205; 482/44, 47; 602/16, 21, 22

(56) References Cited

U.S. PATENT DOCUMENTS

| | | | | | |
|---|---|---|---|---|---|
| 1,602,027 | A | * | 10/1926 | Kennedy | 2/19 |
| 3,994,024 | A | * | 11/1976 | Bates | 2/19 |
| 4,477,927 | A | * | 10/1984 | Tsubota et al. | 2/19 |
| 4,541,127 | A | * | 9/1985 | Gould | 2/19 |
| 4,720,875 | A | * | 1/1988 | Latina et al. | 2/19 |
| 5,012,529 | A | * | 5/1991 | Murai | 2/18 |
| 5,018,221 | A | * | 5/1991 | Romandetto | 2/16 |
| 5,031,238 | A | * | 7/1991 | Hayes | 2/19 |
| 5,031,239 | A | * | 7/1991 | Panichello et al. | 2/19 |
| 5,075,899 | A | * | 12/1991 | Funahashi et al. | 2/19 |
| 5,214,798 | A | * | 6/1993 | McLaughlin | 2/160 |
| 5,379,459 | A | * | 1/1995 | Williams, Jr. | 2/19 |
| 5,398,342 | A | * | 3/1995 | Kinnee et al. | 2/19 |
| 5,457,819 | A | * | 10/1995 | Aoki | 2/19 |
| 5,551,083 | A | * | 9/1996 | Goldsmith | 2/19 |
| 5,572,739 | A | * | 11/1996 | Kolada et al. | 2/19 |
| 5,575,005 | A | * | 11/1996 | Walker et al. | 2/19 |
| 5,671,477 | A | * | 9/1997 | Aoki | 2/19 |
| 5,678,245 | A | * | 10/1997 | Rector et al. | 2/19 |
| 5,694,642 | A | * | 12/1997 | Rector et al. | 2/19 |
| 5,717,994 | A | * | 2/1998 | Goldsmith | 2/19 |
| 5,976,036 | A | * | 11/1999 | Jackson | 473/458 |
| 5,996,117 | A | * | 12/1999 | Goldsmith et al. | 2/16 |
| 6,199,304 | B1 | * | 3/2001 | Ludemann | 36/44 |
| 6,305,022 | B1 | * | 10/2001 | Oomura et al. | 2/19 |

* cited by examiner

*Primary Examiner*—Gary L. Welch
(74) *Attorney, Agent, or Firm*—Terence P. O'Brien

(57) ABSTRACT

A ball glove including front and back glove portions, first, second and third elongate reinforcing members, and a webbing. The front glove portion is coupled to the back glove portion to define a hand cavity and to form first, second, third and fourth finger stalls and a thumb stall. Each finger stall includes a front stall portion and a back stall portion, and each back stall portion includes a distal region and a proximal region. The first, second, and third elongate reinforcing members are coupled to the back stall portions of the first, second and third finger stalls, respectively. The first reinforcing member is positioned at the distal region of the back stall portion of the first finger stall, and the second and third members extend along the distal and proximal regions of the back stall portions of the second and third finger stalls, respectively.

20 Claims, 13 Drawing Sheets

BALL GLOVE WITH REINFORCED FINGER STALLS AND A WRIST PANEL WITH SPACED-APART PADDING

RELATED U.S. APPLICATION DATA

The present invention is a continuation-in-part of U.S. patent application Ser. No. 10/156,584, entitled "Ball Glove With Reinforced Finger Stalls And A Wrist Panel With Spaced-Apart Padding," filed on May 28, 2002 by Sullivano et al. now U.S. Pat. No. 6,634,029.

FIELD OF THE INVENTION

The present invention relates generally to a ball glove for baseball, softball and other sports. In particular, the present invention relates to a ball glove having a plurality of finger stalls with reinforcing members and a wrist pad having a plurality of spaced apart compressible projections.

BACKGROUND OF THE INVENTION

Ball gloves for use in baseball, softball and other sports are well known. Ball gloves typically include a front panel connected to a corresponding back panel to form a hand cavity. The front and back panels typically generally resemble the shape of a human hand and when assembled form five stalls for receiving the thumb and fingers of a user's hand. The front and back panels form a hand opening at the lower edge of the glove. The back panel typically includes a strap or a lower region that generally conforms to the wrist of the user. A webbing is typically connected between the thumb stall and the index finger stall of the ball glove. Ball gloves also typically include a hand opening for enabling a user to insert his or her hand into the hand cavity of the ball glove, and, often, an index finger hole for enabling the user's index finger to rest on the back portion of the index finger stall during use.

Many existing ball gloves have drawbacks. First, the finger stalls of many ball gloves can be too flexible, and, as a result, will have a tendency to bend backwards when impacted by a ball, particularly, when the ball impacts the forward ends of the finger stalls. This backward bending or flexing of the finger stalls can cause the ball, that otherwise would be retained by the glove, to drop. Further, such backward bending can cause the player's fingers to overextend, or otherwise injure the player's fingers. Others have attempted to address this issue by connecting multiple layers of different types of material to further strength the finger stalls and the back panel of the ball glove. Such attempts have resulting in finger stalls of great complexity and multiple materials, increased weight, numerous outwardly extending projections, and/or inefficient positioning of support material.

Further, ball gloves often include a hand-opening of a fixed size which can often be loose on the user's wrist. As a result, such ball gloves are easily mis-positioned on the user's hand and are susceptible to falling off the user's hand, particularly young users. In an effort to overcome this drawback, many ball gloves include fastening mechanisms for tightening or reducing the size of the hand opening around the user's wrist after the user's hand is inserted into the glove. The fastening mechanisms typically take the form of at least one strap, which is secured to the glove at one end and is releasably secured to the glove at a second end with a releasable fastener. The releasable fasteners can include buttons, snap-fit connectors, buckles, or hook and loop type fasteners. Other ball gloves include a resiliently expandable hand opening which enables the user to place his or her hand within the glove and then the hand opening reduces in size to generally conform to the user's wrist. Still other gloves have a hand-opening of a fixed size that is sized to be just large enough for the user's hand to enter the glove.

Ball gloves with adjustable fastening mechanisms at the hand opening, with resiliently expandable hand openings, or with a hand-opening of a small fixed size, often can conform so well to the user's wrist that they can irritate the user's wrist. Further, such gloves can also cause the user's hand to perspire excessively or to generally overheat. In an effort to make such gloves more comfortable, many gloves include inner wrist panels or pads intended to cushion the contact between the user's wrist and the back panel or strap of the back panel. Such cushioned wrist pads, while softening the contact between the glove and the user's wrist, can also significantly restrict or block air flow into and out of the ball glove, thereby further causing the user's hand to further perspire or overheat.

Thus, there is a continuing need for a ball glove having a finger stalls with reinforcing members optimally positioned on the back portion of the finger stalls to inhibit rearward bending of the finger stalls upon impact with a ball, without negatively affecting the weight, comfort, appearance or performance of the glove. There is also a need for a ball glove having a wrist pad that comfortably conforms to the wrist of the user without causing the user's hand within the glove to over heat or excessively perspire. It would be advantageous to provide a ball glove with finger stalls that easily flex in a forward or closing position but restrict or inhibit rearward bending. What is also needed is a ball glove having a wrist pad that facilitates the insertion and removal of the user's hand within the glove. It would also be advantageous to provide a ball glove that provides these advantages and also provides the ball glove with an improved, more appealing aesthetic.

SUMMARY OF THE INVENTION

The present invention provides a ball glove for use by a player to facilitate catching a ball. The ball glove includes front and back glove portions, first, second and third elongate reinforcing members, and a webbing. The front glove portion is coupled to the back glove portion to define a hand cavity and to form first, second, third and fourth finger stalls and a thumb stall. Each finger stall includes a front stall portion and a back stall portion, and each back stall portion includes a distal region and a proximal region. The first, second, and third elongate reinforcing members are coupled to the back stall portions of the first, second and third finger stalls, respectively. The first member has a length that is shorter than each of the second and third members. The first reinforcing member is positioned at the distal region of the back stall portion of the first finger stall, and the second and third members extend along the distal and proximal regions of the back stall portions of the second and third finger stalls, respectively. The elongate reinforcing members inhibit rearward bending of the finger and thumb stalls upon impact with the ball during use. The webbing is coupled to, and positioned between, the first finger stall and the thumb stall.

According to a principal aspect of a preferred form of the invention, a ball glove includes front and back glove portions, at least one elongate reinforcing member and a webbing. The back glove portion is coupled to the front glove portion to define a hand cavity and to form a plurality of finger stalls and a thumb stall. Each finger stall includes a front stall portion and a back stall portion. One of the elongate reinforcing member is coupled to the back stall portion of one of the finger stalls and the thumb stall. Each reinforcing member includes at least two reinforcing member segments that are positioned end to end along the stall. A webbing is coupled to, and positioned between, one of the finger stalls and the thumb stall.

According to another principal aspect of a preferred form of the invention, a ball glove for receiving a hand, and generally conforming to a wrist of a user, includes front and back portions, and a wrist pad. The front portion has a front lower edge. The back portion is coupled to the front portion to form a hand cavity. The back portion has a back lower region having inner and outer surfaces. The wrist pad is coupled to the inner surface of the lower back region. The wrist pad includes a plurality of inwardly extending projections. The projections are spaced apart to define at least one channel.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
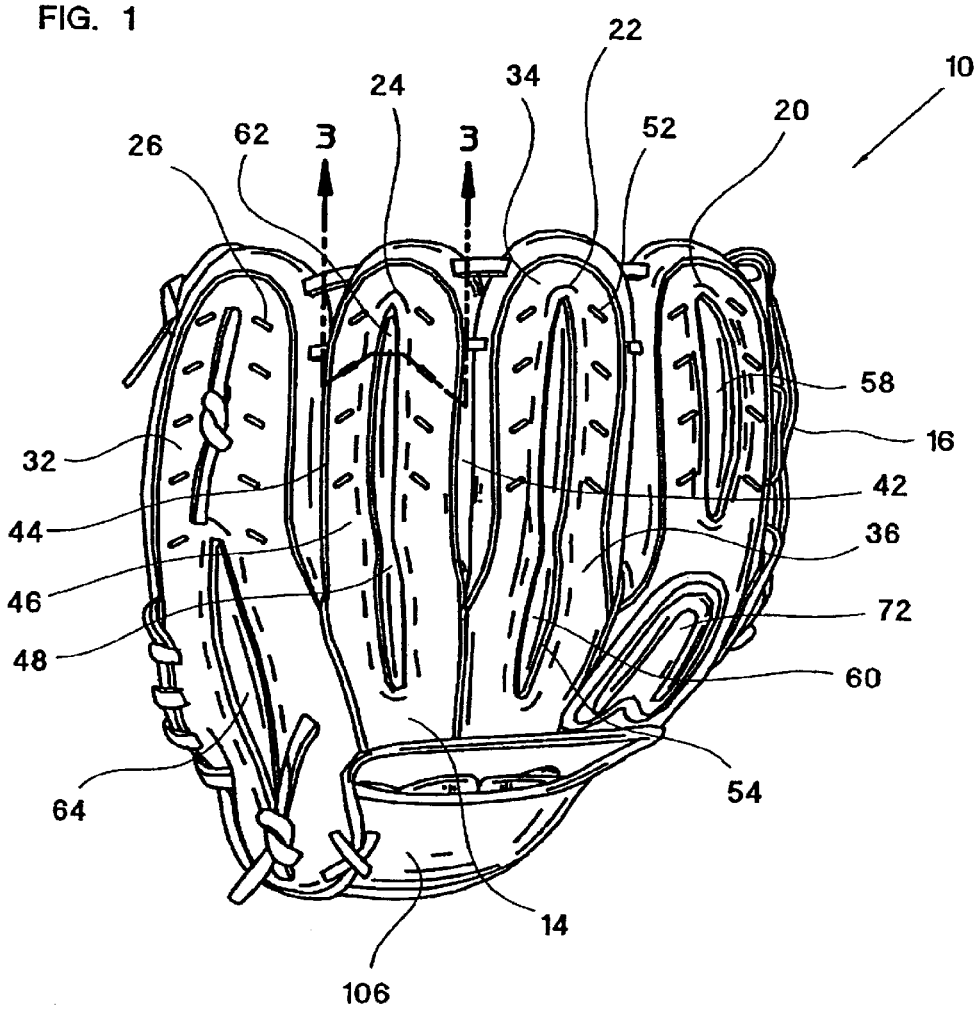
FIG. 1 is a rear view of a ball glove in accordance with a preferred embodiment of the present invention.
Figure 2:
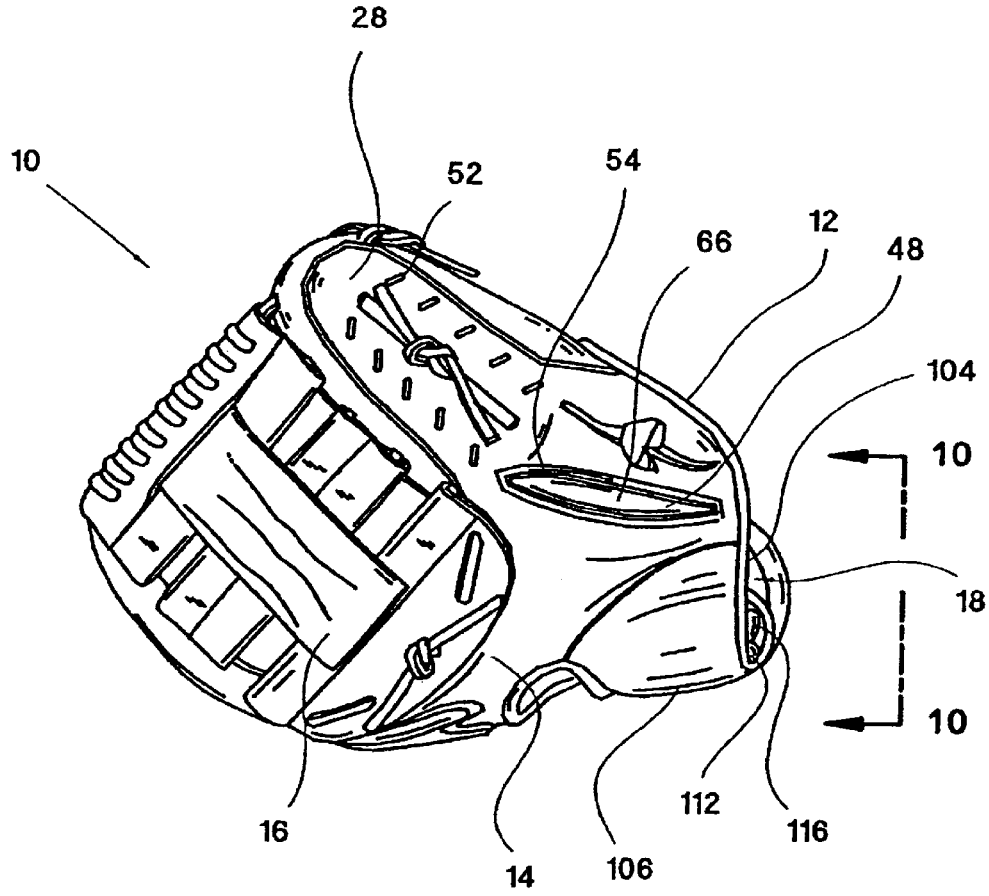
FIG. 2 is a side view of the ball glove of FIG. 1.

Referring to FIGS. 1 and 2, a ball glove is indicated generally at 10. The ball glove 10 is configured for use in baseball, softball, hockey and other sports involving ball gloves. The ball glove 10 can also be referred to as a mitt. The present invention is directly applicable to any ball glove or ball mitt including, for example, a first baseman mitt and a catcher's mitt. The ball glove 10 includes a front glove portion 12, a back glove portion 14 and a webbing 16. The front and back portions 12 and 14 are contoured sheet-like structures, each resembling a hand. The front and back portions 12 and 14 are connected together to define a hand cavity 18, and to form first, second, third and fourth finger stalls 20, 22, 24, 26, and a thumb stall 28. The front and back portions 12 and 14 are preferably stitched together. Alternatively, the front and back portions 12 and 14 can be connected through other means, such as, for example, bonding, molding or adhesive. The front portion 12 covers and protects the palm-side of the user's hand from impact with the ball. The back portion 14 supports the front portion 12 and protects the backside of the user's hand. The front and back portions 12 and 14 are made of a pliable, durable, and relatively soft material, preferably leather. In alternative preferred embodiments, the front and back portions 12 and 14 can be made of other materials, such as, for example, artificial leather, composite leather, rubber and plastic. The webbing 16 is a generally flat structure that is connected, and preferably stitched, to the front and back portions 12 and 14 between the first finger stall 20 and the thumb stall 28.

Figure 3:
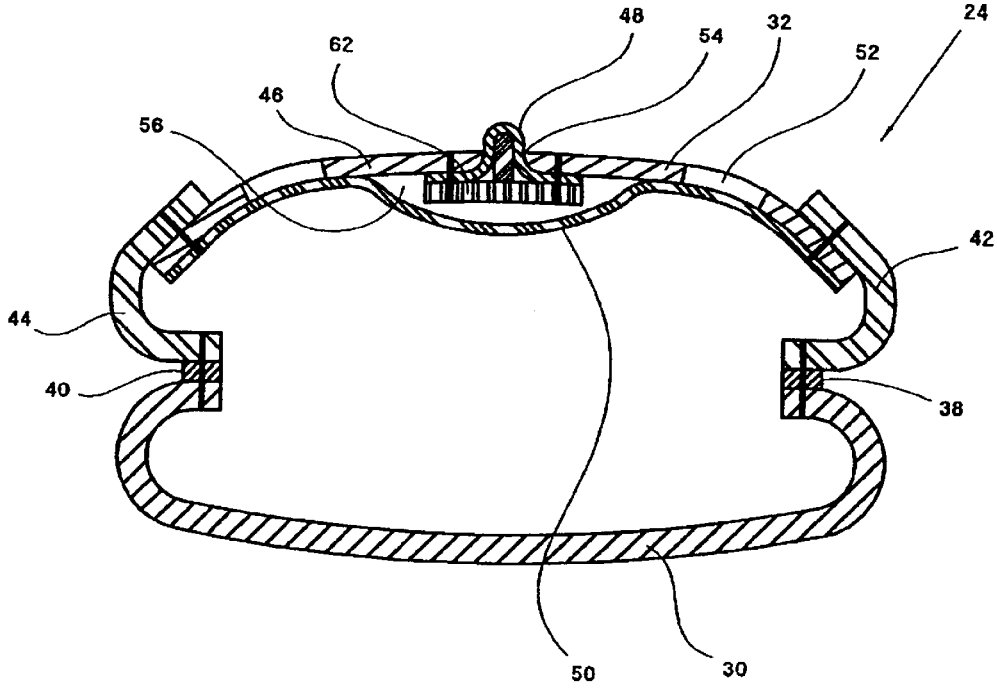
FIG. 3 is a cross-sectional view of a finger stall of the ball glove taken along line 3—3 of FIG. 1.

Referring to FIGS. 1–3, the finger stalls 20–26 and the thumb stall 28 are elongate cavities adapted for receiving the fingers and thumb of the user. Each finger stall 20–26 includes a front stall portion 30 and a back stall portion 32, and each back stall portion 32 includes a distal region 34 and a proximal region 36. The front and back stall portions 30 and 32 are coupled to each other, preferably through a first and second welting 38 and 40 and a stitching. Alternatively, the front and back stall portions 30 and 32 can be connected through other means, such as, for example, stitching only, bonding, or molding.

Figure 6:
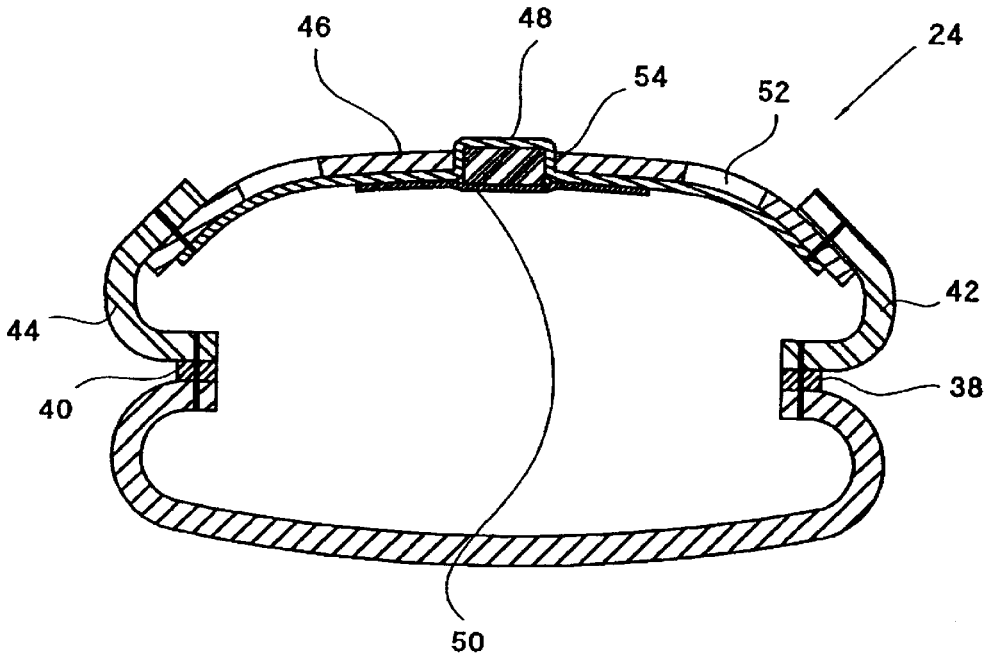
FIG. 6 is a cross-sectional view of a finger stall of the ball glove in accordance with another alternative preferred embodiment of the present invention.

The back stall portion 32 preferably includes first and second side panels 42 and 44, a primary outer panel 46, a secondary outer panel 48 and an inner lining 50. The first and second side panels 42 and 44 are elongate strips of material each extending along a separate side of the finger stall. Preferably, the first and second panels 42 and 44 are formed of a single strip of material extending up both sides of the finger stall and around the distal end of the finger stall. The first and second side panels 42 and 44 are connected at one edge to the first and second welting 38 and 40, respectively, and at an opposing edge to the primary outer panel 46. The primary outer panel 46 extends between the first and second side panel 42 and 44 and generally covers the back outermost central portion of the back stall portion 32. The primary outer panel 46 preferably includes a plurality of spaced-apart angled slots 52 and an elongated narrow slit 54, which extends over a significant portion of the length of the primary outer panel 46. The secondary outer panel 48 is a narrow sheet that longitudinally extends beneath the primary outer panel 46 and substantially covers the slit 54 from an inner side of the primary outer panel 46. The inner lining 50 is positioned inward of the primary and secondary outer panels 46 and 48 and also connects, preferably through stitching, to primary outer panel 46 and the first and second side panels 42 and 44. Alternatively, as shown in FIG. 6, the inner lining 50 can be connected directly to the primary outer panel 46 and not the first and second side panels 42 and 44.

Referring to FIG. 3, the first and second side panels 42 and 44 and the primary and secondary outer panels 46 and 48 are formed of a flexible, durable material, preferably a leather. Alternatively, the first and second side panels 42 and 44 and the primary and secondary outer panels 46 and 48 can be formed of other materials, such as, for example, a synthetic leather, a composite leather, a plastic, a rubber or a combination thereof. The inner lining 50 is made of a soft, flexible material, preferably a leather or a textile. Alternatively, the inner lining 50 can be formed of other materials such as, for example, a woven fabric, a non-woven fabric, a silk or other conventional lining material.

The primary and secondary outer panels 46 and 48 and the inner lining 50 form an elongate compartment 56 in each of the finger stalls 20–26 and the thumb stall 28 for receiving first, second, third, fourth and fifth elongate reinforcing members 58, 60, 62, 64 and 66, respectively. In alternative preferred embodiment, one or more of the finger stalls 20–26 and the thumb stall 28 include an elongate compartment and an elongate reinforcing member.

Figure 4:
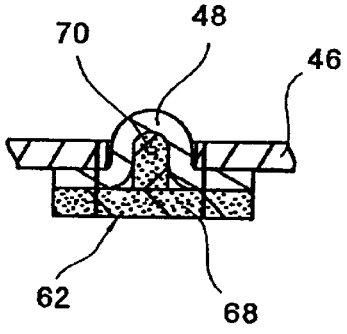
FIG. 4 is a partial view of the finger stall of FIG. 3.

The first, second, third, fourth and fifth elongate reinforcing members 58, 60, 62, 64 and 66 are long, narrow assemblies coupled to separate finger and thumb stalls 20, 22, 24, 26 and 28, respectively. Referring to FIGS. 3 and 4, in a preferred embodiment, one of the reinforcing members 58–66 is stitched to the primary and secondary outer panels 46 and 48 of the back stall portion 32. In alternative preferred embodiments, the reinforcing members 58–66 can be attached to the back stall portions 32 through alternative means, such as, for example, an adhesive, a hook and loop fastener, snap fit connectors or other conventional fasteners. Each reinforcing member 58–66 is formed of at least one elongated, supporting unit which has a higher stiffness, and preferably a higher hardness, than the material of the finger and thumb stalls 20–28. In a preferred embodiment, the reinforcing members 58–66 are formed of an elastomeric material. Alternatively, the reinforcing members can be formed of other materials, such as, for example, metal, plastic, rubber or wood.

In a particularly preferred embodiment, the reinforcing members 58–66 each include a first and second elongate reinforcing elements 68 and 70, wherein the first element 68 is a generally flat strip of material extending generally parallel to the primary outer panel 46 and the second element 70 is a strip of material extending generally perpendicular to the first element 68. The first and second elements 68 and 70 provide the reinforcing member 54–62 with a general inverted T cross-section. Other configurations or cross-sectional shapes of the reinforcing member 54–62 can also be used. In a preferred embodiment, the first and second elements 68 and 70 are formed of the substantially the same material. The elongate reinforcing members 58–66 are configured to support the finger and thumb stalls 20–28 and to inhibit rearward bending of the finger and thumb stalls 20–28 when the stalls are impacted by a ball, particularly when impacted at the tip or end of the finger stalls 20–26. The reinforcing members 58–66 enable the glove to retain its form and facilitate catching of a ball by resisting undesirable deformation of the finger and thumb stall 20–28 which can lead to a dropped ball. The reinforcing members 58–66 also help prevent overextending, overstressing or other injury to the player's fingers by inhibiting rearward bending of the player's fingers.

Referring to FIG. 1, in a preferred embodiment, the first reinforcing member 58 has a length that is shorter than the second or third reinforcing members 60 and 62. The first reinforcing member 58 is coupled to the distal region 34 of the back stall portion 32 of the first finger stall 20 and the second and third reinforcing members 60 and 62 extend over, and are coupled to, the distal and proximal regions 34 and 36 of the back stall portion 32 of the second and third finger stalls 22 and 24.

The first reinforcing member 58 preferably extends over at least 30 percent of the length of the back stall portion 32 of the first finger stall 20. In a particularly preferred embodiment, the first reinforcing member 58 preferably extends over at least 40 percent of the length of the back stall portion 32 of the first finger stall 20. The second and third reinforcing members 60 and 62 preferably extend over at least 70 percent of the length of the back stall portions 32 of the second and third finger stalls 22 and 24, respectively. In a particularly preferred embodiment, the second and third reinforcing members 60 and 62 preferably extend over at least 80 percent of the length of the back stall portions 32 of the second and third finger stalls 22 and 24, respectively. By placing the first reinforcing member 58 at the distal region 34 of the first finger stall 20, an index finger opening (not shown) can be formed into, and, preferably, an index finger protector 72 can be connected to, the proximal region 36 of the back stall portion 32 of the first finger stall 20. This configuration enables the distal region 34 of the first finger stall 20 to be properly reinforced without negatively affecting other desirable features of the glove, such as the use of the index finger opening and the index finger protector 72. Incorporation of the index finger protector 72 into the glove provides the user with the flexibility of leaving his or her index finger within the first finger stall 20 or on the back side of the first finger stall 20.

The fourth and fifth reinforcing members 64 and 66 are coupled to at least the proximal region 36 of fourth finger stall 26 and the thumb stall 28, respectively. Alternatively, the fourth and fifth reinforcing members can be coupled to the distal region only or to both the proximal and distal regions. In an alternative preferred embodiment, the fifth reinforcing member 66 can extend over any percentage of the length of the back stall portions of the thumb stall 28. In additional alternative preferred embodiments, one or more of the first and fifth reinforcing members 58 and 66 can be coupled to one or more of the proximal region and the distal region of the first finger stall 20 and the thumb stall 28, respectively.

The primary outer panel 46, the secondary outer panel 48 and the first and second side panels can be formed in a single color or in one or more different colors. The ball glove of the present invention also has a unique and appealing appearance.

Figure 5:
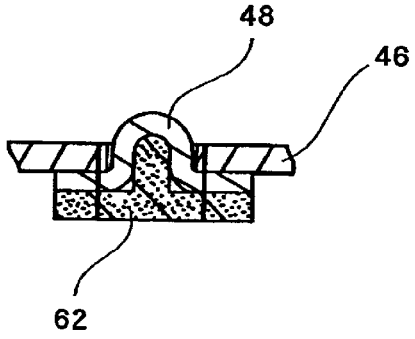
FIG. 5 is a sectional view of a rear portion of a finger stall of a ball glove in accordance with an alternative preferred embodiment of the present invention.

Referring to FIGS. 5 and 6, in alternative preferred embodiments, the reinforcing members, indicated as 62, can be formed of a single reinforcing element having an inverted T cross-sectional area (see FIG. 5) or a rectangular cross-sectional area (see FIG. 6). Alternatively, other cross-sectional shapes can also be used. In other alternative preferred embodiments, the reinforcing members can be attached directly to the back stall portions of the finger and thumb stalls without a layer of material placed over the reinforcing members. Also, referring to FIG. 6, the secondary outer panel 48 can be formed of a greater width such that the secondary outer panel 48 connects with the first and second side panels 42 and 44.

Figure 9:
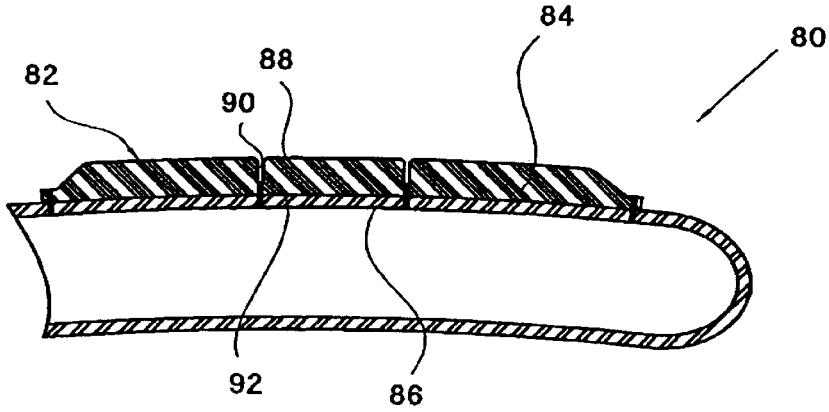
FIG. 9 is a longitudinal sectional view of a finger stall of a ball glove back portion of a ball glove in accordance with yet another alternative preferred embodiment of the present invention.
Figure 7:
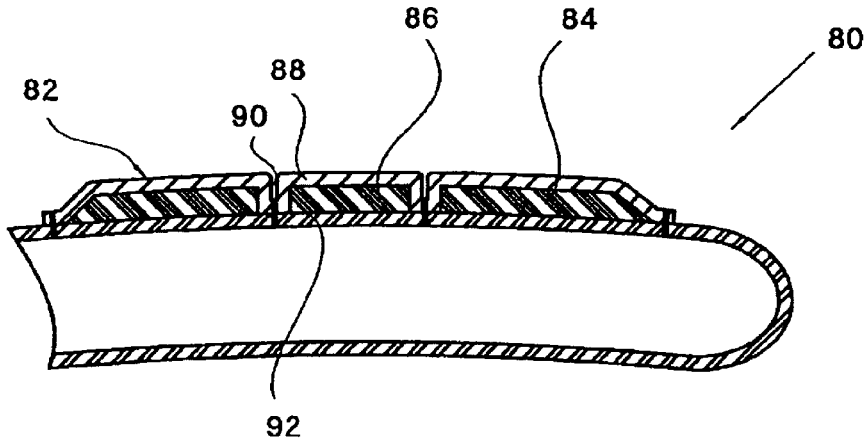
FIG. 7 is a longitudinal sectional view of a finger stall of a ball glove back portion of a ball glove in accordance with an alternative preferred embodiment of the present invention.
Figure 8:
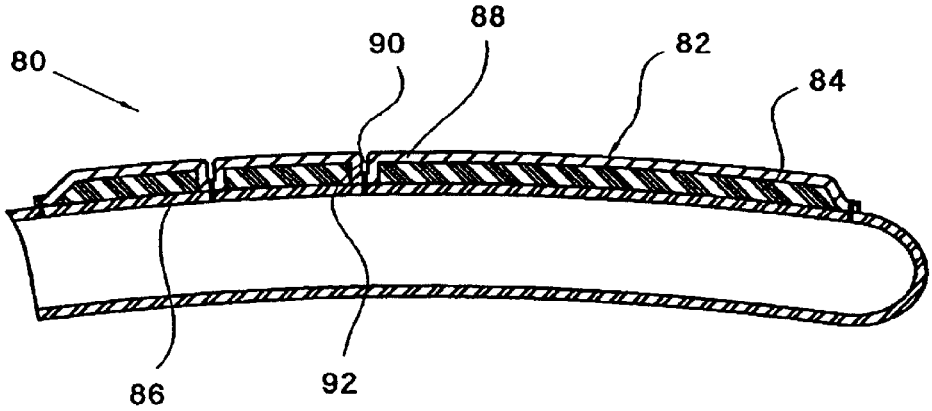
FIG. 8 is a longitudinal sectional view of a finger stall of a ball glove back portion of a ball glove in accordance with another alternative preferred embodiment of the present invention.

Referring to FIGS. 7 through 9, in an alternative preferred embodiment, a finger stall 80 of a ball glove can include a reinforcing member 82 formed of two or more reinforcing segments 84. The two or more reinforcing segments 84 are positioned end to end along the major longitudinal dimension of a back stall portion 86 of the finger stall 80. The reinforcing segments 84 are coupled to the back stall portion 86 of the finger stall 80. Referring to FIGS. 7 and 8, in a particularly preferred embodiment, an outer panel 88 extends over the reinforcing segments 84 and connects to the back stall portion 86 of the finger stall 80. In alternative embodiments, the reinforcing segments 84 can be connected to the back stall portion 86 of the finger stall 80, with or without an outer panel (see FIG. 9), and through other means, such as for example, stitching, or adhesives.

A transverse gap 90 is formed between the ends of two of the reinforcing segments 84. The ends of the reinforcing segments 84 are preferably positioned in close proximity to each other. In a particularly preferred embodiment, abutting ends 92 of the reinforcing segments are squared off. The reinforcing segments 84 are configured to enable the user to bend his or her finger forward within the glove and to resist rearward bending or rearward extension of the fingers of the user. The transverse gaps 90 are preferably positioned at the approximate location of the user's knuckles such that the finger stall 80 pivots forward with the forward bending of the user's finger enabling the user to easily curl or forwardly bend his or her finger within the finger stall 80 and the finger stall 80 itself. The reinforcing segments with the squared off ends resist or inhibit rearward bending or flexing of the finger stall 80 thereby facilitating the ability of the user to catch the ball, particularly a ball impacting a far forward end of the finger stall 80. The reinforcing segments 84 can take any shape provided that each segment includes at least one abutting end 92 for interacting with another adjacent abutting end 92. Each reinforcing segment can include a plurality of ribs forming an abutting end at one end of the ribs.

Figure 13:
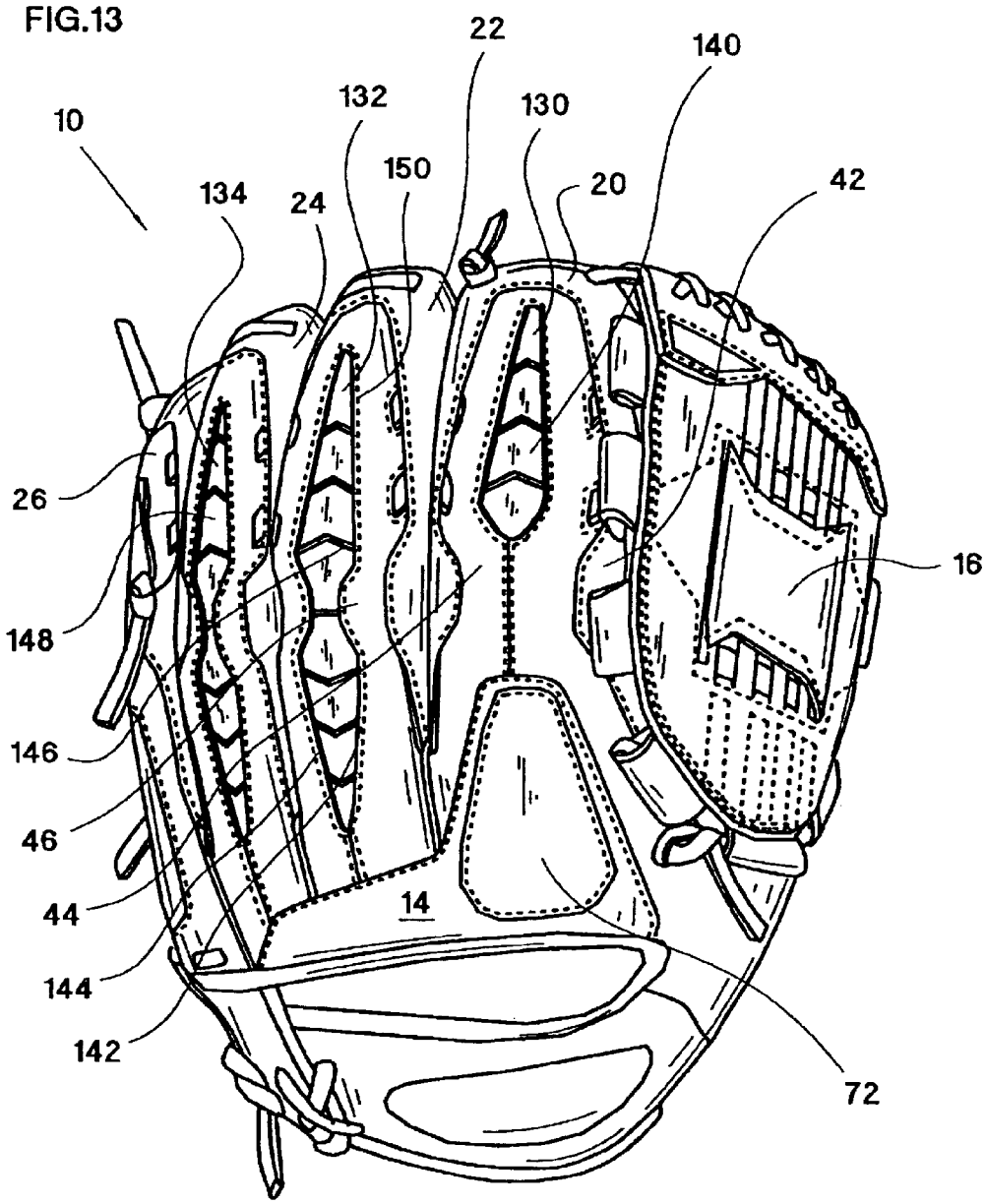
FIG. 13 is a rear side view of a ball glove in accordance with another preferred embodiment of the present invention.
Figure 14:
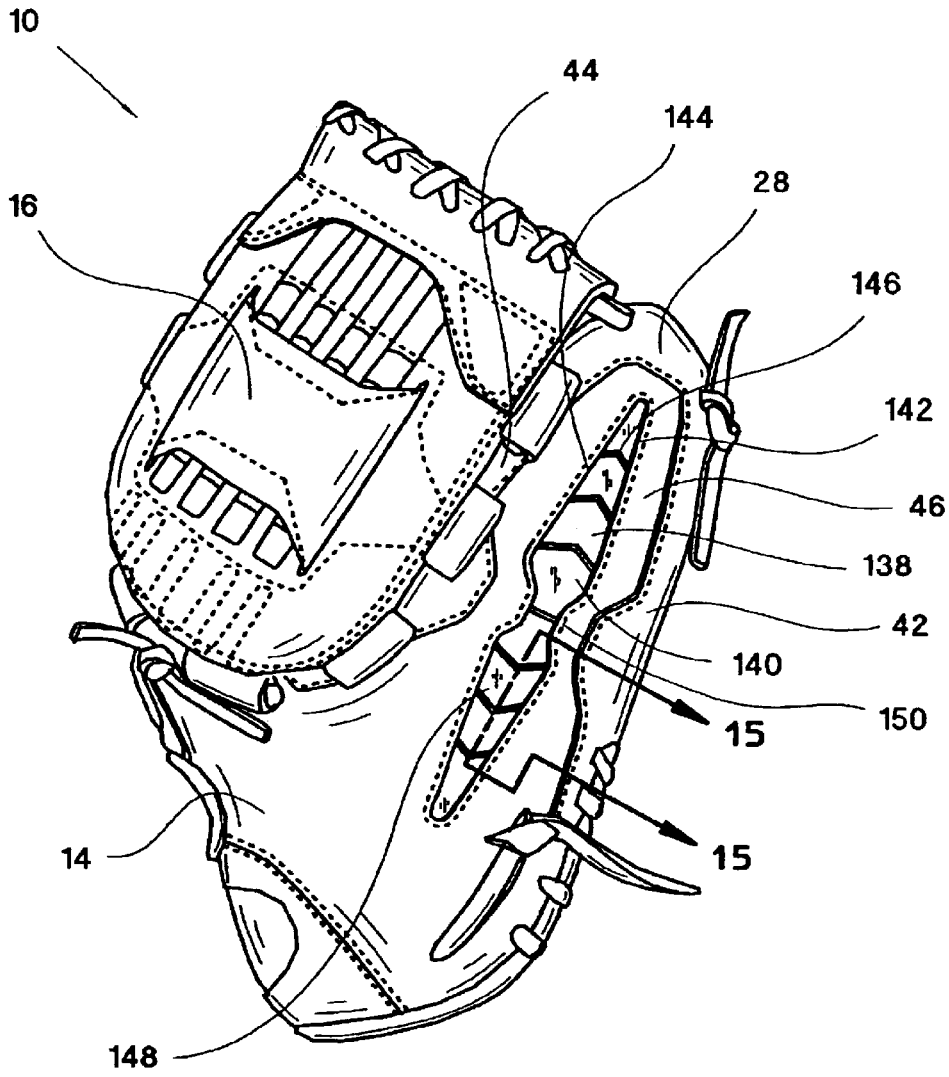
FIG. 14 is a side view of the ball glove of FIG. 13.
Figure 15:
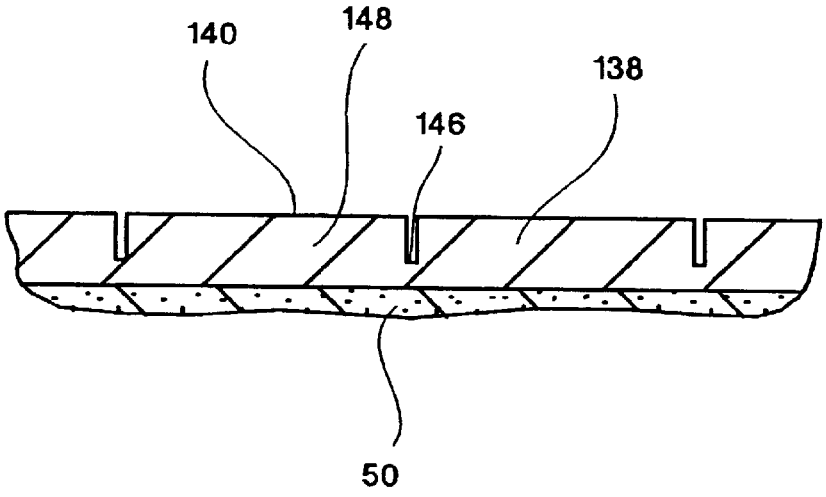
FIG. 15 is a sectional view a back stall portion and a reinforcing member taken along line 15—15 of FIG. 14.

Referring to FIGS. 13–20, an alternative preferred embodiment of the glove 10 is illustrated, in which the finger and thumb stalls 20, 22, 24, 26 and 28 include a slotted reinforcing member 130, 132, 134, 136 and 138, respectively. Each slotted reinforcing member includes an outer surface 140, first and second exposed side edges 142 and 144, and at least one slot 146. With the exception of the slots 146, the slotted reinforcing members 130, 132, 134, 136 and 138 are substantially similar to the reinforcing members 58, 60, 62, 64 and 68 (see FIGS. 1 and 2). Referring to FIGS. 14 and 15, the at least one slot 146 is defined into each of the reinforcing member 130–138 and preferably extends from the first exposed side edge 142 to the second exposed side edge 144. Each slot 146 inwardly, or downwardly, extends from the outer surface 140 into the reinforcing members 130–138. The depth of the slots 146 preferably does not extend the entire thickness of the reinforcing members, but rather, a portion thereof. In one preferred embodiment, each slot 146 has a depth, which is at least 50% of the thickness of the reinforcing member. In another preferred embodiment, each slot 146 has a depth, which is at least 60% of the thickness of the reinforcing member. In other alternative preferred embodiments, other slot depths can also be used. In yet other alternative preferred embodiments, the depth of one or more of the slots can vary, and/or a portion of the slot may extend the entire depth of the reinforcing member. In another alternative preferred embodiment, the at least one slot can have a length that extends over a portion of the reinforcing member between the first and second side edges, but not the entire length between the first and second side edges.

Referring to FIGS. 13, 14, and 15, the slots 146 preferably define a path extending between the first and second side edges 142 and 144 that is either straight (a straight line between side edges 142 and 144) or a V-shaped path. In alternative preferred embodiments, the path defined by the slots within the reinforcing member can be U-shaped, sinusoidal, jagged, irregular, or otherwise curved or angled between the first and second side edges of the reinforcing members. Further, combinations of the above-listed slot paths can also be used.

Figure 16:
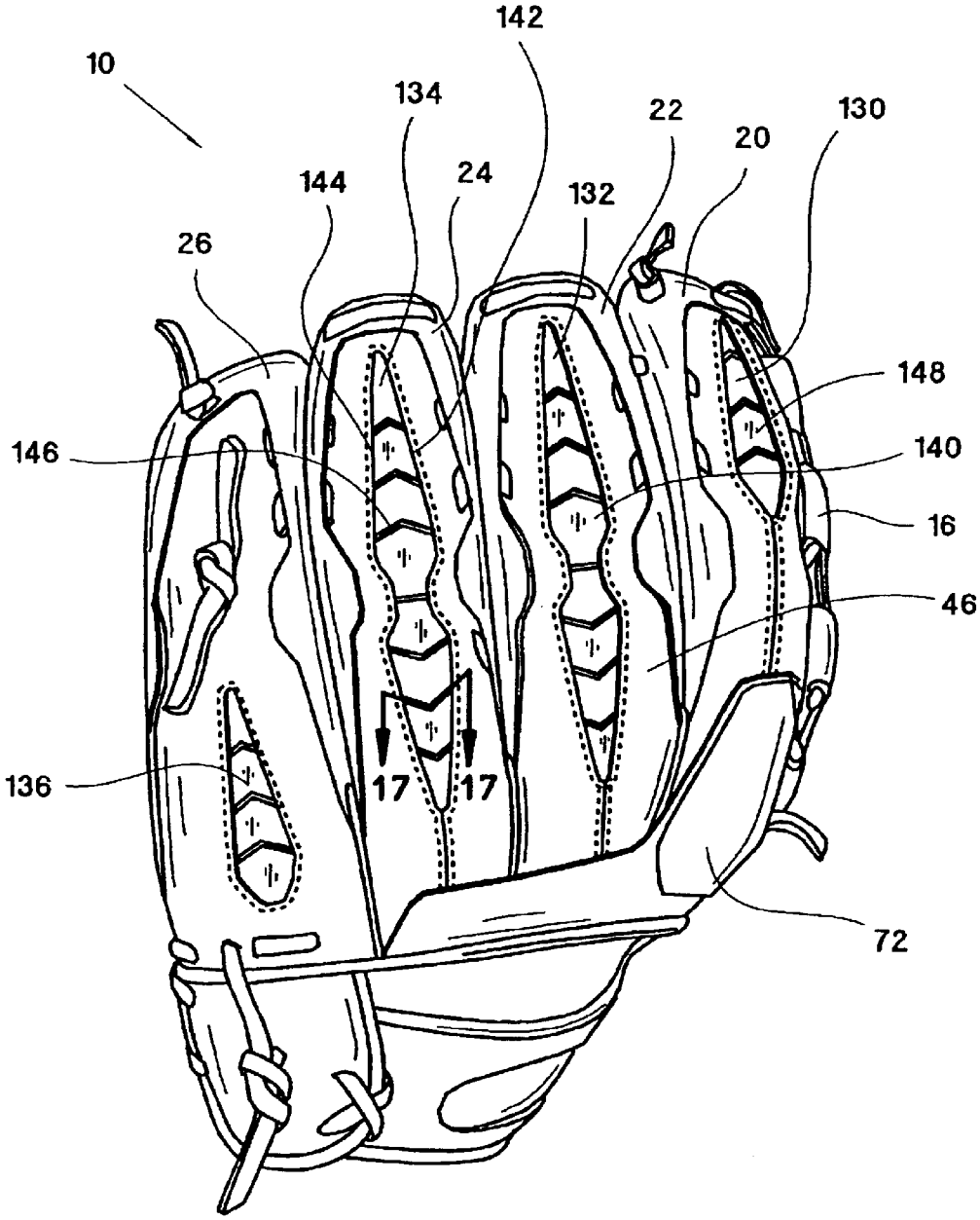
FIG. 16 is a rear view of the ball glove of FIG. 13.
Figure 18:
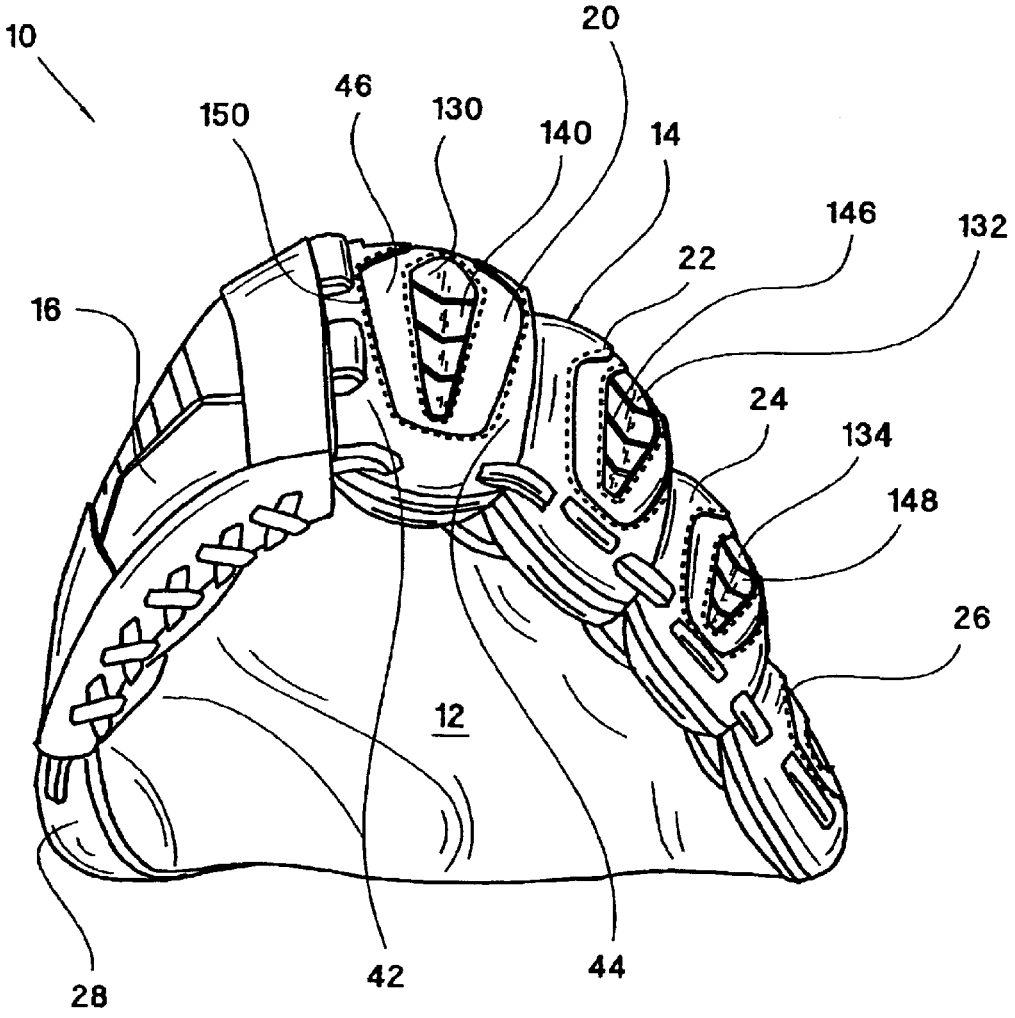
FIG. 18 is a top view of the ball glove of FIG. 13.
Figure 19:
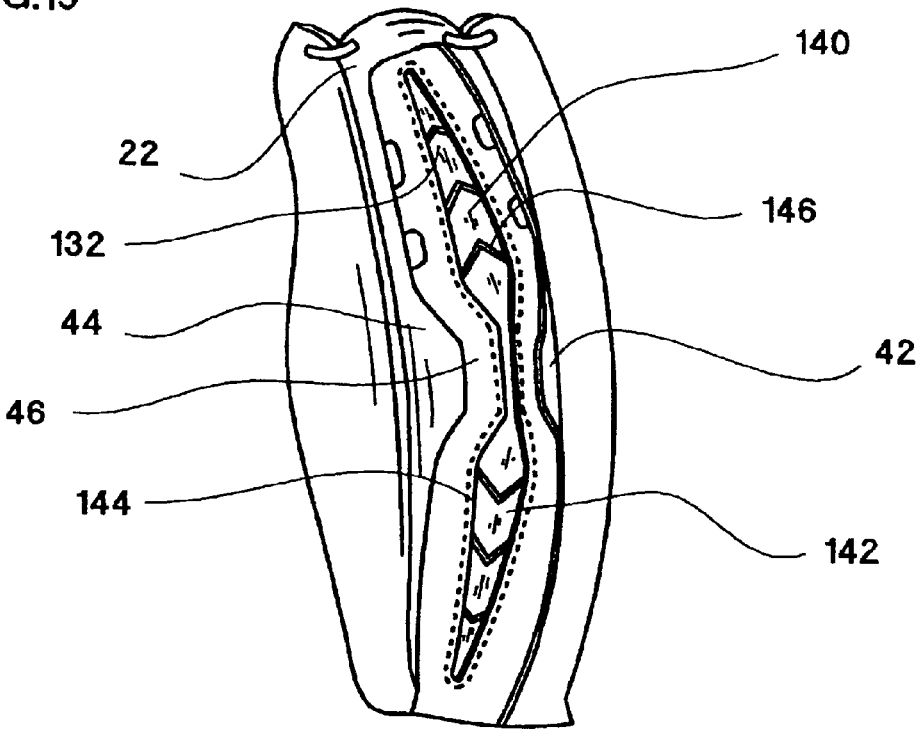
FIG. 19 is a rear perspective view of a second finger stall of the ball glove of FIG. 13.
Figure 20:
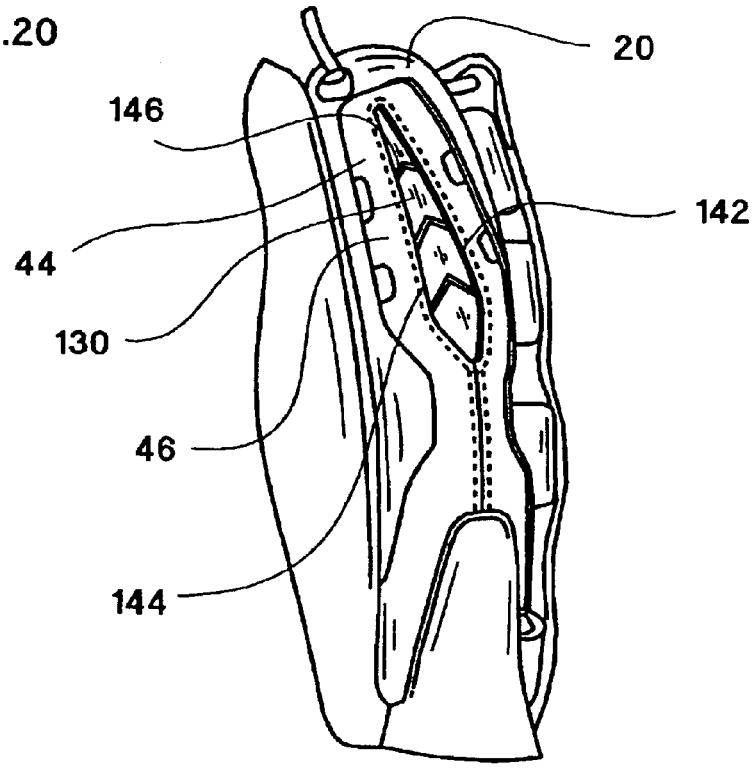
FIG. 20 is a rear perspective view of a first finger stall of the ball glove of FIG. 13.

Referring to FIGS. 13, 14 and 16, in one particularly preferred embodiment, the second, third and thumb reinforcing members 132, 134 and 138 each include seven slots 146 and the first and fourth reinforcing members 130 and 136 each include three slots 146. In alternative preferred embodiments, the reinforcing members 130–138 can include other numbers of slots 146. In another preferred embodiment, one or more reinforcing member can be formed without a slot. Additionally, each reinforcing member 130–138 can include an equal number of slots, a different number of slots, and combinations thereof.

Referring to FIGS. 13, 14 and 15, the slots 146 enable the user to flex the finger and/or thumb stalls inwardly, while inhibiting over-extension of the finger and thumb stalls and undesirable rearward bending of the user's fingers within the stalls. The slots 146 define a plurality of outwardly projecting reinforcing segments 148 within the reinforcing members 130–138. When a rearward bending force is applied to the finger and thumb stalls, which often occurs upon catching a ball, the reinforcing segments 148 move closer together, closing at least a portion of the slots and allowing for opposing surfaces of the reinforcing segments 148 to contact each other. This contact restricts or inhibits rearward movement of the stall. The width of the slots 146 is advantageously selected to provide the desired amount of rearward flexing before the reinforcing segments contact each other. In one particularly preferred embodiment, the width of the slots 146 is less than 0.100 inches. In another particularly preferred embodiment, the width of the slots is less than 0.050 inches. In other alternative preferred embodiments, other slot width dimensions can also be used.

Figure 17:
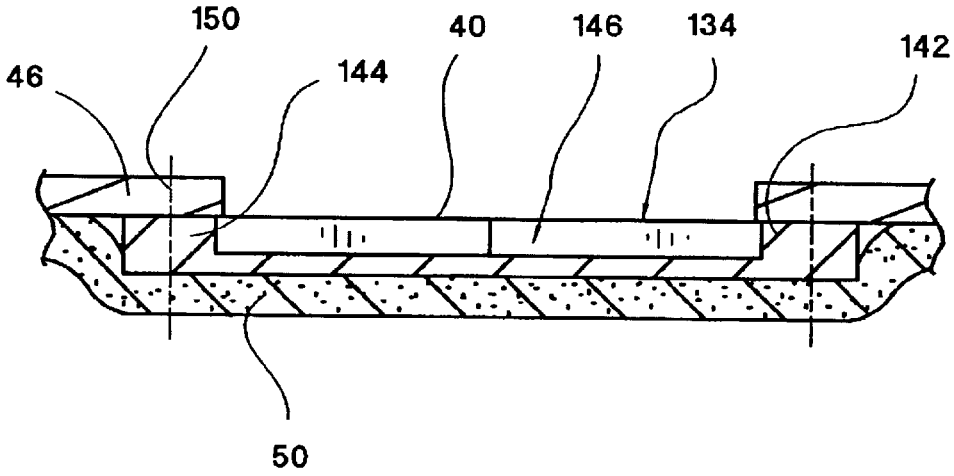
FIG. 17 is a sectional view of another back stall portion and another reinforcing member taken alone line 17—17 of FIG. 16.

Referring to FIGS. 16 and 17, the reinforcing members 130–138 are preferably positioned at the outer surface of the inner lining 50 and are partially covered by the primary outer panel 46. A stitching 150 preferably is used to attach the reinforcing members 130–138 between the primary outer panel 46 and the inner lining 50 of their respective stalls. In alternative preferred embodiments, the reinforcing members 130–138 can be attached to the finger and thumb stalls 20–28 through other means, such as, for example, adhesive bonding, snap-fit connections, and combinations thereof. Preferably, a portion of the outer surface 140 of the reinforcing members 130–138 remains exposed. Alternatively, the secondary outer panel 48 (see FIG. 3) can be used to cover all or a portion of the exposed reinforcing members. The slot 146 preferably extends from the first exposed side edge 142 to the second exposed side edge 144. In alternative preferred embodiments, the slot can extend the entire width of the reinforcing members or a portion thereof. In another alternative preferred embodiment, a central portion of the reinforcing members can be raised so as to at least partially outwardly extend through the opening defined in the primary outer panel 46 for the reinforcing members.

Figure 10:
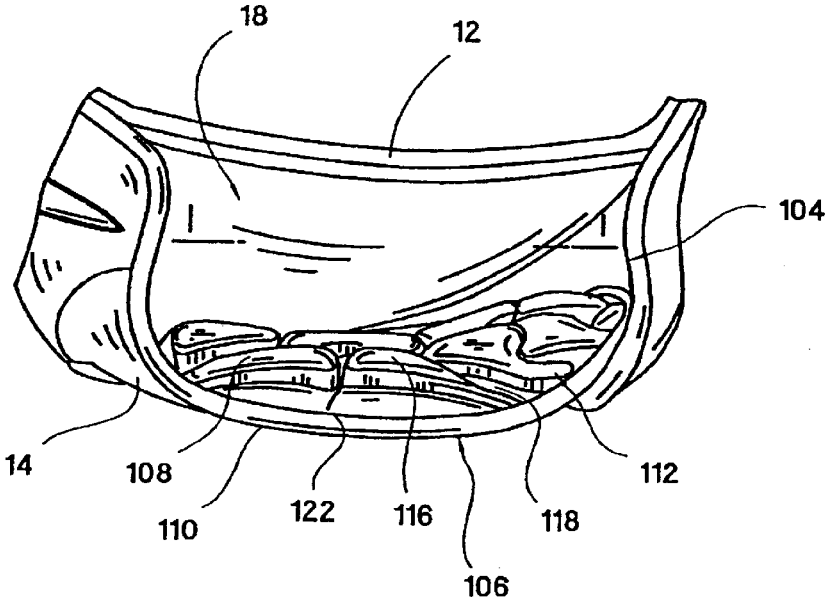
FIG. 10 is a sectional end view of the ball glove of FIG. 2.

Referring to FIGS. 2 and 10, the ball glove 10 is shown in greater detail. The front and back glove portions 12 and 14 include front and back lower edges 100 and 102 that define a hand opening 104 providing access to the hand cavity 18 of the glove 10. The back glove portion 14 further includes a back lower region 106 having inner and outer surfaces 108 and 110. A wrist pad 112 is coupled to the inner surface 108 of the back lower region 106. In a particularly preferred embodiment, the wrist pad 112 is stitched to the back lower region 106. Alternatively, the wrist pad 112 can be connected to the back lower region 106 through other means, such as, for example, bonding, molding, hook and loop type fasteners, snap connectors or other conventional fastening means.

Figure 12:
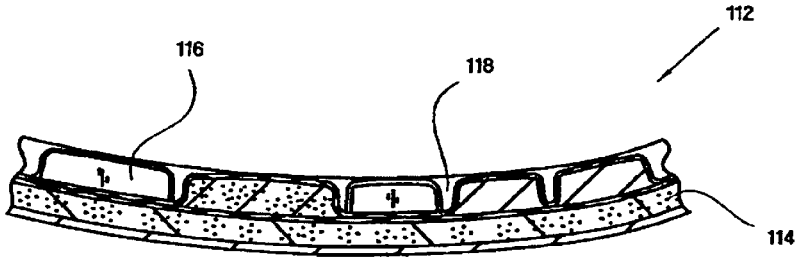
FIG. 12 is a sectional view of the wrist pad taken along line 12—12 of FIG. 11.
Figure 11:
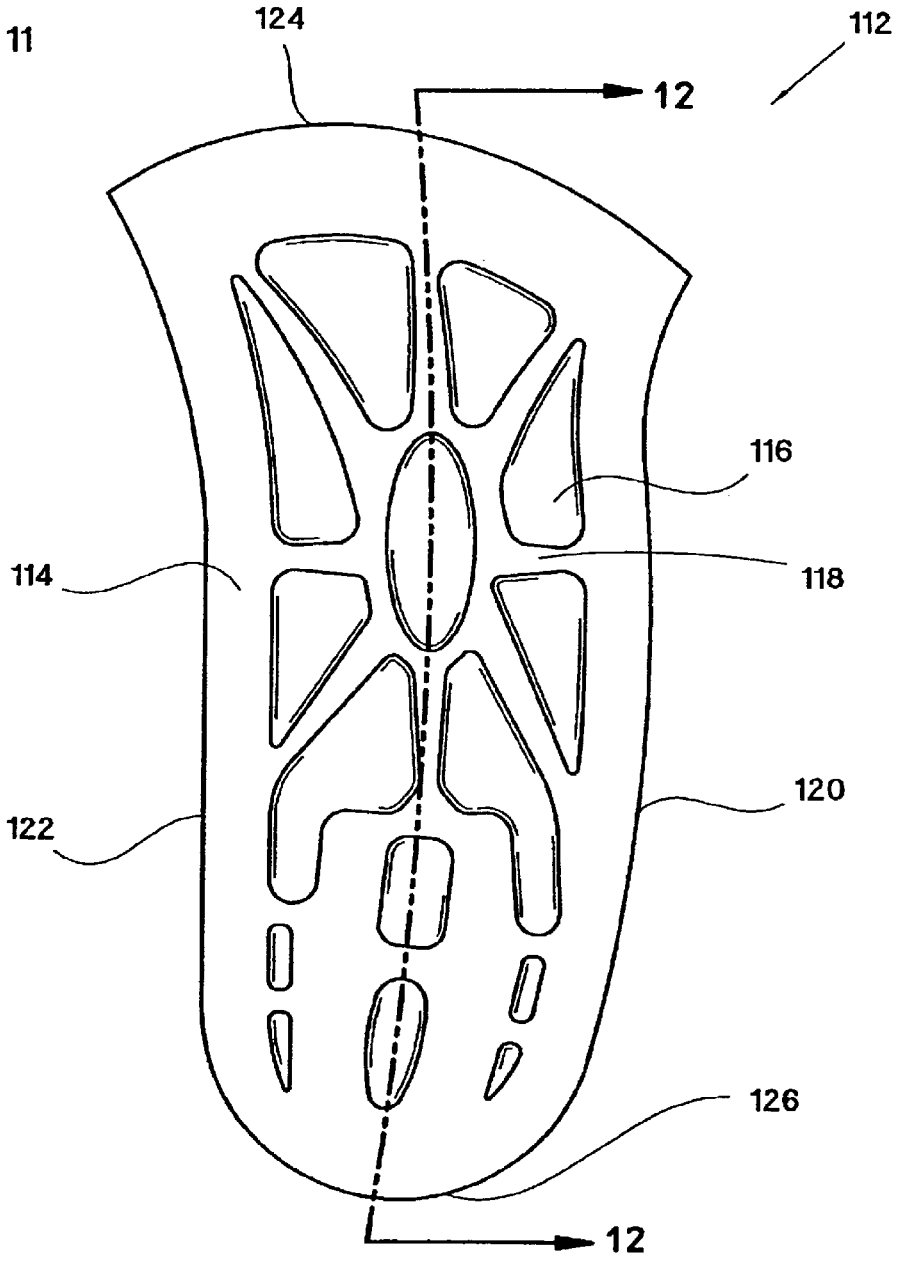
FIG. 11 is a top view of a wrist pad prior to assembly into a ball glove.

Referring to FIGS. 10–12, the wrist pad 112 includes a generally flat sheet 114 having a plurality of inwardly extending projections 116. The projections 116 are spaced apart across the sheet 114 to define at least one channel 118 extending across the pad 112. The projections 116 inwardly extend from the sheet 114 by a predetermined amount, which can be uniform across the projections or can vary from one projection to another. The projections 116 can be formed in a variety of shapes including round, circular, oval, polygonal, irregular or combinations thereof. The sheet 114 and the projections 116 are preferably formed of a compressible, resilient material. In a particularly preferred embodiment, the sheet 114 and projections 116 include a cellular foam. In alternative preferred embodiments, the sheet 114 and the projections 116 can be formed with a gel, a fluid, a non-cellular foam, or other cushionable material.

The wrist pad 112 has a set of first and second opposing edges 120 and 122 and a set of third and fourth opposing edges 124 and 126. The at least one channel 118 continuously extends across from one of the edges to at least one of the remaining edges. In a particularly preferred embodiment, the wrist pad 112 includes a plurality of channels 118 that collectively and continuously extend between all four edges 120–126. The padded sheet 114 and padded projections 116 comfortably contact the back side of the user's wrist and enable the user to comfortably wear the glove 10, even for extended periods. The channels 118 allow air to flow across and along the pad 112 thereby providing a ventilation path from the hand cavity 18. The air flow across the wrist pad 112 helps to prevent the user's hand from over heating or from perspiring excessively and facilitates extended comfortable wear of the glove 10.

While the preferred embodiments of the present invention have been described and illustrated, numerous departures therefrom can be contemplated by persons skilled in the art. For example, one or more of the reinforcing members and the wrist pad can be interchangeably and releasably connected to the glove. Therefore, the present invention is not limited to the foregoing description but only by the scope and spirit of the appended claims.

What is claimed is:

1. A ball glove for use by a player to facilitate catching a ball, the ball glove comprising:

a front glove portion;

a back glove portion coupled to the front glove portion to define a hand cavity and to form first, second, third and fourth finger stalls and a thumb stall, each finger stall including a front stall portion and a back stall portion, each back stall portion including a distal region and a proximal region;

first, second, and third elongate reinforcing members coupled to the back stall portions of the first, second and third finger stalls, respectively, the first member having a length that is shorter than each of the second and third members, each of the reinforcing members having first and second side edges, at least one of the reinforcing members having at least one slot extending into the reinforcing member between the first and second side edges, the elongate reinforcing members configured to inhibit rearward bending of the finger and thumb stalls upon impact with the ball during use; and a webbing coupled to, and positioned between, the first finger stall and the thumb stall.

2. The ball glove of claim 1, further comprising a fourth elongate reinforcing member coupled the back stall portion of the fourth finger stall.

3. The ball glove of claim 1, further comprising a fifth elongate reinforcing member coupled to the thumb stall.

4. The ball glove of claim 1, further comprising a finger protector connected to the proximal region of the back stall portion of the first finger stall.

5. The ball glove of claim 1, wherein the second and third elongate reinforcing members extend over at least 70 percent of the length of the back stall portions of the second and third finger stalls, respectively.

6. The ball glove of claim 1, wherein the first elongate reinforcing members extends over at least 30 percent of the length of the back stall portions of the first finger stall.

7. The ball glove of claim 1, wherein each of the elongate reinforcing members includes at least one slot.

8. The ball glove of claim 7, wherein each of the elongate reinforcing members include at least three slots.

9. The ball glove of claim 1, wherein the at least one slot defines a path between the first and second side edges, and wherein the path defined by the at least one slot is selected from the group consisting of a straight line, a V-shaped path, a U-shaped path, an angled path, a jagged path, a sinusoidal path, a curved path, an irregularly shaped path, and combinations thereof.

10. The ball glove of claim 1, wherein the reinforcing members have a predetermined thickness, and wherein the at least one slot has a maximum depth sized to be at least 50 percent of the predetermined thickness.

11. The ball glove of claim 10, wherein the maximum depth of the at least one slot is at least 60 percent of the predetermined thickness.

12. The ball glove of claim 1, wherein the at least one slot has a width which is less than 0.050 inches.

13. A ball glove comprising:

a front glove portion;

a back glove portion coupled to the front glove portion to define a hand cavity and to form a plurality of finger stalls and a thumb stall, each finger stall including a front stall portion and a back stall portion;

at least one elongate reinforcing member, one of the reinforcing members being coupled to the back stall portion of one of the finger stalls and the thumb stall, at least one slot defined into the reinforcing members to form at least two reinforcing member segments, the reinforcing member segments configured to not overlap each other; and a webbing coupled to, and positioned between one of the finger stalls and the thumb stall.

14. The ball glove of claim 13, wherein each of the finger stalls includes one of the elongate reinforcing members.

15. The ball glove of claim 13, wherein the thumb stall includes one of the elongate reinforcing members.

16. The ball glove of claim 13, wherein the at least one elongate reinforcing member includes at least three slots.

17. The ball glove of claim 13, wherein the at least one slot defines a path between the first and second side edges, and wherein the path defined by the at least one slot is selected from the group consisting of a straight line, a V-shaped path, a U-shaped path, an angled path, a jagged path, a sinusoidal path, a curved path, an irregularly shaped path, and combinations thereof.

18. The ball glove of claim 13, wherein the reinforcing members have a predetermined thickness, and wherein the at least one slot has a maximum depth sized to be at least 50 percent of the predetermined thickness.

19. The ball glove of claim 13, wherein the maximum depth of the at least one slot is at least 60 percent of the predetermined thickness.

20. The ball glove of claim 13, wherein the at least one slot has a width which is less than 0.050 inches.

* * * * *